United States Patent [19]

Hamai et al.

[11] 4,442,821

[45] Apr. 17, 1984

[54] INTERNAL COMBUSTION ENGINE IGNITION METHOD

[75] Inventors: Kyugo Hamai, Yokosuka; Yasuhiko Nakagawa, Kamakura; Meroji Nakai, Yokosuka; Ryuzaburo Inoue, Yokohama, all of Japan

[73] Assignee: Nissan Motor Co., Ltd., Yokohama, Japan

[21] Appl. No.: 335,831

[22] Filed: Dec. 30, 1981

[30] Foreign Application Priority Data

Jan. 12, 1981 [JP] Japan ..... 56-2190

[51] Int. Cl.[3] ..... F02P 5/04

[52] U.S. Cl. ..... 123/639; 123/620; 123/641

[58] Field of Search ..... 123/639, 636, 637, 638, 123/640, 641, 424, 179 BG, 620

[56] References Cited

U.S. PATENT DOCUMENTS

| | | | |
|---|---|---|---|
| 1,877,332 | 9/1932 | Laisne . | |
| 3,418,990 | 12/1968 | Lindell, Jr. | 123/640 |
| 3,620,201 | 11/1971 | Warren et al. | 123/637 |
| 3,704,591 | 12/1972 | Tatsutomi | 123/640 |
| 4,122,816 | 10/1978 | Fitzgerald et al. | 123/640 |
| 4,133,329 | 1/1979 | Caron | 123/637 |
| 4,369,756 | 1/1983 | Ezoe | 123/640 |
| 4,398,526 | 8/1983 | Hamai et al. | 123/620 |

FOREIGN PATENT DOCUMENTS

| | | | |
|---|---|---|---|
| 963525 | 2/1975 | Canada | 123/639 |
| 1121947 | 8/1962 | Fed. Rep. of Germany . | |
| 1001078 | 10/1951 | France . | |
| 2505952 | 11/1982 | France . | |
| 959892 | 6/1964 | United Kingdom . | |
| 455200 | 1/1975 | U.S.S.R. | 123/639 |
| 693043 | 11/1979 | U.S.S.R. | 123/637 |

*Primary Examiner*—Parshotam S. Lall

*Attorney, Agent, or Firm*—Lane, Aitken & Kananen

[57] ABSTRACT

In order to improve the cold starting efficiency of a an internal combustion engines using alcohol or low cetane type fuel, an ignition method provides an ignition mode in which a plurality of energizations of the ignition plugs per cycle is effected during engine cold starting operation which is detected by sensing at least one of the engine temperature and the engine speed. The number of energizations per cycle is returned to one after the engine has sufficiently warmed up. The method is applied to both of a plasma ignition system and a conventional spark ignition system.

8 Claims, 9 Drawing Figures

INTERNAL COMBUSTION ENGINE IGNITION METHOD

FIELD OF THE INVENTION

The present invention relates generally to an ignition method for an internal combustion engine and more specifically to a method for facilitating the start of a cold engine.

DESCRIPTION OF THE PRIOR ART

In both prior art Otto and diesel cycle engines, it is a known practice to attempt to initiate combustion in the combustion chambers thereof, once per cycle of the engine (viz., once per compression stoke of the engine) irrespective of the various operating parameters of the engine. The same practice is also applied to diesel cycle engines wherein spontaneous ignition will tend to occur only once per cycle. Even in diesel cycle engines wherein the glow plug has been replaced with a plasma ignition system to eliminate the ignition delay, which is apt to occur during starting and idling, still only one energization is made per cycle.

However, this method has suffered from the drawback that, in the case of Otto cycle engines for example, when the temperature of the engine is particularly low, fuel supplied either by a carburetor or a fuel injection system is poorly atomized with the result that the air-fuel mixture in the immediate vicinity of the spark plug tends to be lean whereby ignition of the air-fuel charge is inhibited. In diesel cycle engines, when the temperature is low, the problem is even more pronounced and combustion is apt not to take place even when a plasma ignition system is employed. These cold start problems are even more pronounced when alcohol or "gasohol" (a mixture of gasoline and alcohol) are used in Otto cycle engines or a low cetane number diesel fuel is used in diesel engines for the purposes of reducing fuel costs.

SUMMARY OF THE INVENTION

The present invention provides a method which improves the cold starting efficiency of engines especially those using alcohol or low cetane type fuels by effecting a plurality of spark ignitions or energizations per cycle in place of a single normal energization so as to vastly increase the probability of successfully inducing combustion of an air-fuel mixture. The method further provides for returning the number of energizations back to one, energization per cycle after the engine has sufficiently warmed up.

It is therefore an object of the present invention to provide an ignition method which improves cold starting of an internal combustion engine.

It is another object of the present invention to utilize plasma ignition to carry out the aforementioned method in the case of diesel cycle engines.

BREIF DESCRIPTION OF THE DRAWINGS

The features and advantages of the arrangement of the present invention will become more clearly appreciated from the following description taken in conjunction with the accompanying drawings in which:

FIGS. 1A to 1C, when combined together, show a block diagram of a first embodiment of the present invention which takes the form of a plasma ignition system for a four cylinder diesel engine;

DETAILED DESCRIPTION OF THE PREFERRED EMBODIMENTS

Figure 1A:
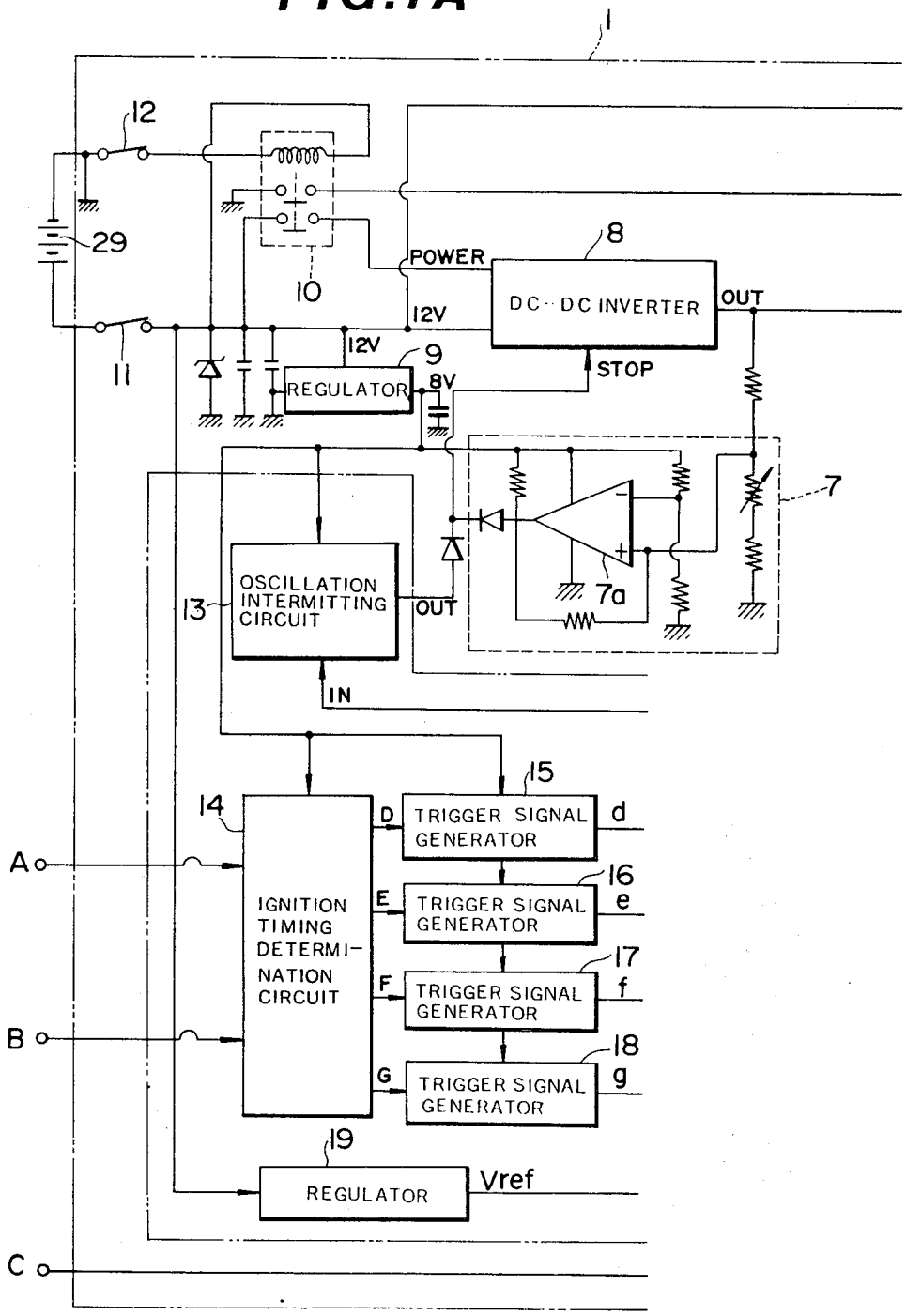
Figure 1B:
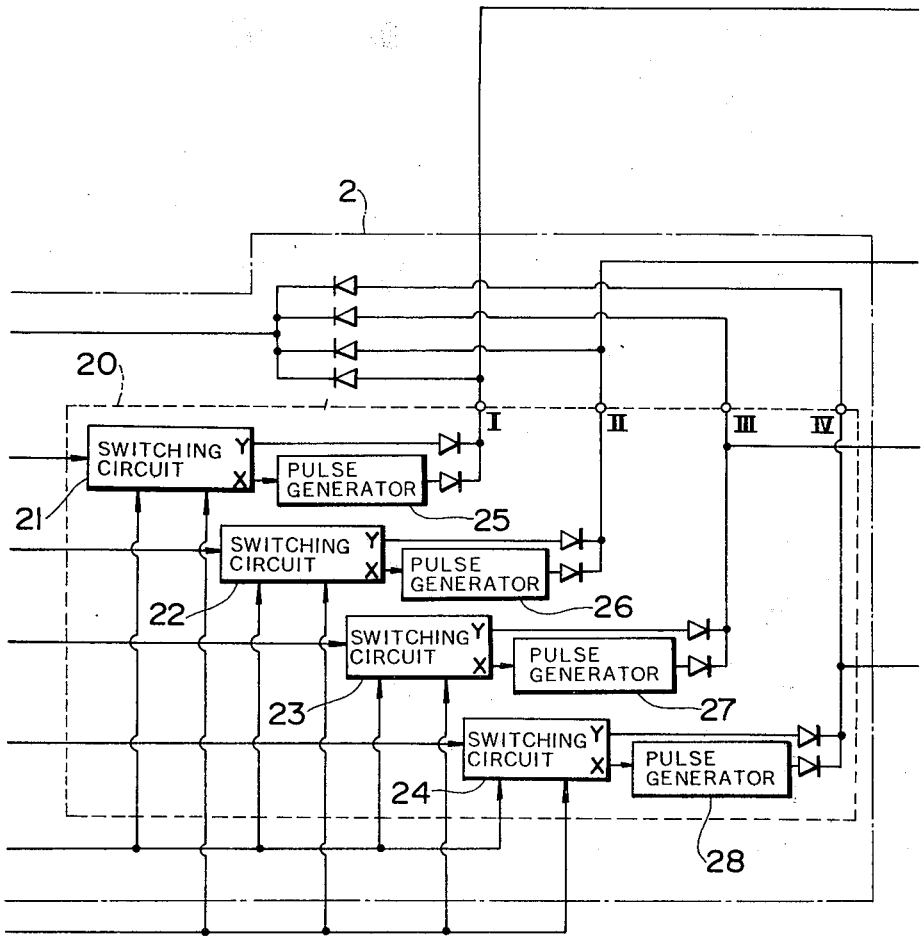
Figure 1C:
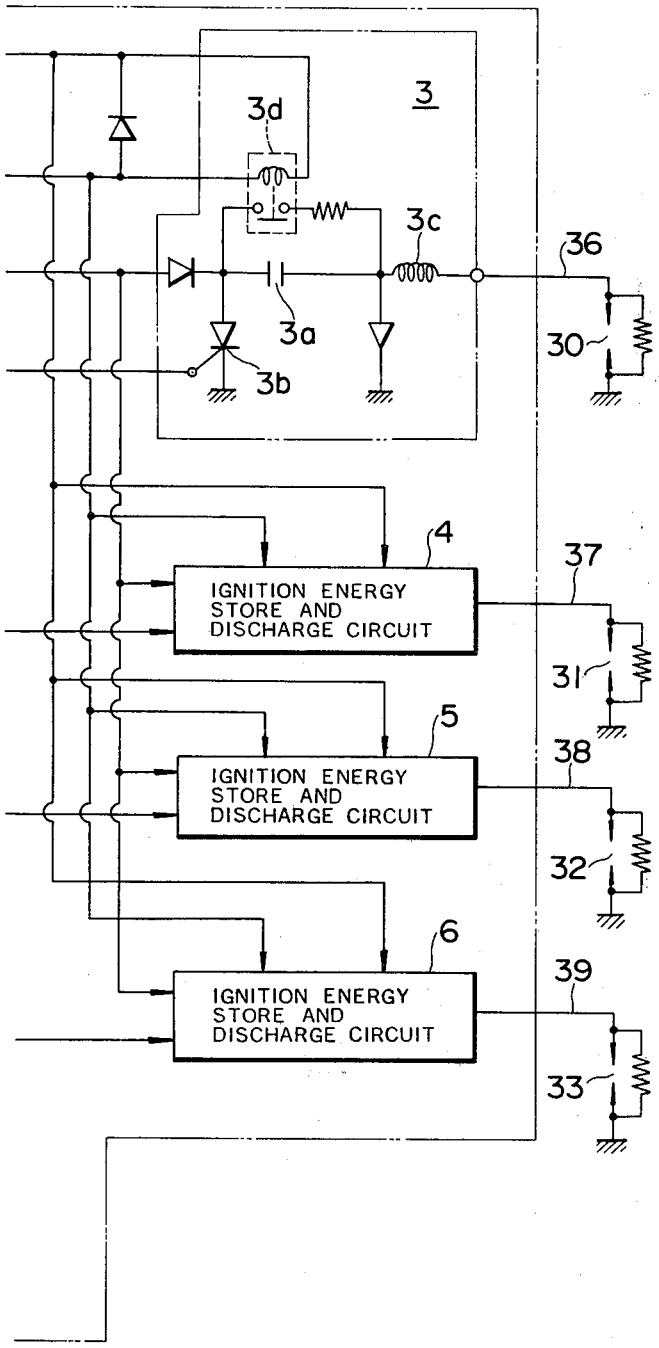

Turning now to the drawings and more particularly to FIG. 1, showing a block diagram of a plasma ignition system associated with a four cylinder diesel engine, a first embodiment of the present invention is explained.

As shown, a plasma ignition system 1 comprises an ignition timing control circuit generally designated by the reference numeral 2 and illustrated as the portion enclosed by the dotted line, ignition energy store and discharge circuits 3 to 6, a voltage control circuit generally designated by the reference numeral 7 and illustrated as the portion enclosed by the dashed line, a DC-DC inverter 8, a voltage regulator 9, a power supply relay 10, a power switch 11, a plasma ignition switch 12 and an electric power source in the form of a battery 29.

The ignition timing control circuit 2 includes an oscilation intermitting circuit 13, an ignition timing determination circuit 14, signal generators 15 to 18, and an ignition mode switching circuit generally designated by the reference numeral 20 and illustrated as a portion enclosed by the dashed line. The ignition mode switching circuit 20 includes switching circuits 21 to 24 and pulse generators 25 to 28 respectively associated with the switching circuits.

The ignition energy store and discharge circuit 3 comprises a capacitor **3*a* for storing the ignition energy, a thyristor 3*b* for controlling the discharge of the ignition energy, an inductance coil 3*c*, and a relay 3*d* having normally closed contacts for short circuiting the capacitor 3*a*** when the plasma ignition system is not operated.

The other ignition energy store and discharge circuits 4 to 6 are constructed in the same manner as the ignition energy store and discharge circuit 3. Therefore, detailed explanations of each such circuits 4 to 6 are omitted.

The operation of the above described plasma ignition system 1 is explained as follows.

Initially, the power switch 11 is turned on by the operation of the ignition switch (not shown). After that, the plasma ignition switch 12 is turned on to energize a relay coil of the power supply relay 10. As the result, the power voltage from the battery 29 is supplied to the DC-DC inverter 8 which produces a high tension voltage at the output terminal thereof. This high tension voltage is applied to each of the ignition energy store and discharge circuits 3 to 6 and accumulated in the respective capacitors corresponding to the capacitor **3*a*** provided therein.

In order to regulate the output voltage of the DC-DC inverter 8, and precisely charge these capacitors with a predetermined amount of energy, the operation of the DC-DC inverter 8 is controlled by the voltage control circuit 7. As shown, the voltage control circuit 7 has a comparator *7a* therein which compares a divided value of the output high tension voltage level from the DC-DC inverter 8 with a reference voltage derived from a power voltage from the voltage regulator 9. The comparator *7a* produces an output when the divided output voltage of the DC-DC inverter 8 becomes higher than the reference voltage level, and an oscillation circuit within the DC-DC inverter 8 is stopped by this output signal of the comparator *7a*.

The electric charge stored in the capacitor *3a* in the ignition energy store and discharge circuit 3 is discharged into the plasma ignition plug 30 via the inductance coil *3c* and the high tension cable 36, when the thyrister *3b* is triggered by a trigger signal produced by the ignition timing control circuit 2 whose operation is explained hereinafter.

Thus, the plasma ignition plugs 30 to 33 are in turn in a like manner by the ignition energy store and discharge circuits 3 to 6 so that the plasma ignition takes place at an optimum ignition timing in accordance with a predetermined order of ignition.

Figure 2:
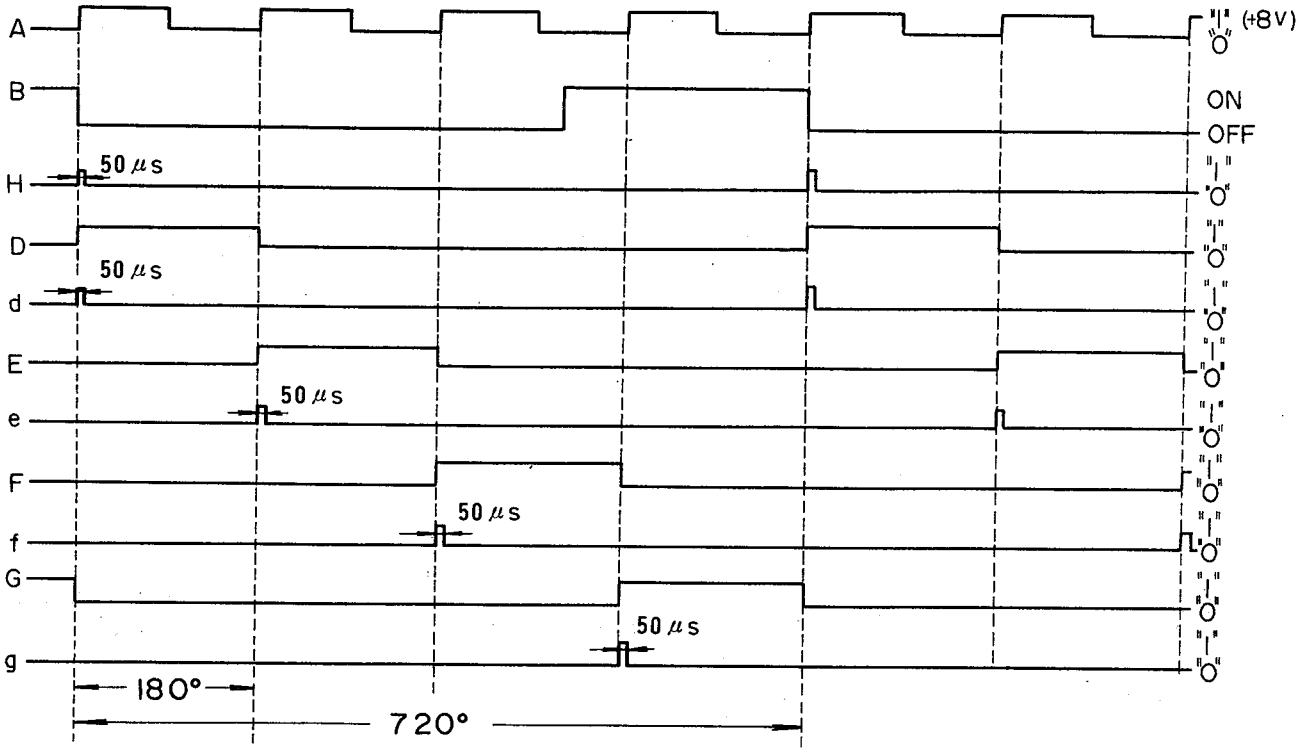
FIG. 2 is a timing chart showing the operation of the plasma ignition system in FIG. 1.

In the ignition timing control circuit 2, the ignition timing determination circuit 14 receives an ignition timing signal A having a repetition rate corresponding to a 180° rotation of the engine crank shaft and an engine cycle signal B having a repetition rate corresponding to a 720° rotation of the engine crankshaft, in the case of the four cylinder engine, respectively shown in the timing diagram FIG. 2.

The ignition timing signal A can be derived from a fuel injection valve control signal, and the engine cycle signal B is produced, for example, by a crankshaft position sensor including a disk mounted on a shaft, such as a cam shaft, which rotates through 180 degrees per one revolution of the crankshaft and an electromagnetic pick up for sensing the angular position of the disk.

The ignition timing determination circuit 14 includes by way of example a ring counter (which alternately may be replaced by a shift register or the like) which is reset by a pulse H produced by a one-shot multivibrator (not shown) at each trailing edge of the signal B. This ring counter respectively outputs signals D to G at each fourth leading edge of the ignition timing signal A in a manner wherein each signal D to G sequentially assumes a high level for a period defined between two trailing edges of the ignition timing signal A upon whereupon the former signal falls to a low level. Viz., as signal D falls to a low level, signal E assumes a high level, until at the next leading edge of the ignition timing signal A, signal E falls to a low level and signal F assumes a high level. Subsequently, as signal F falls to a low level, signal G assumes a high level until the next leading edge whereat signal D once again assumes a high level.

These signals D to G are respectively applied to the trigger signal generators 15 to 18 which respectively produce first trigger signals Td to Tg for triggering the thyrister *3b* in the ignition energy store and discharge circuit 3, and the thyristers corresponding to thyrister *3b* in the corresponding circuits 4 to 6, synchronously with the leading edge of the signals D to G.

The first trigger signals Td to Tg respectively produced by the trigger signal generators 15 to 18 are then transmitted to the ignition mode switching circuit 20 where one of a first ignition mode and a second ignition mode is selected. In the first ignition mode, a single energization of the plasma ignition plug is effected during the ignition time. In the second ignition mode, a plurality of energizations take place in accordance with a set of second trigger signals which are produced in synchronization with the first trigger signal.

Figure 3:
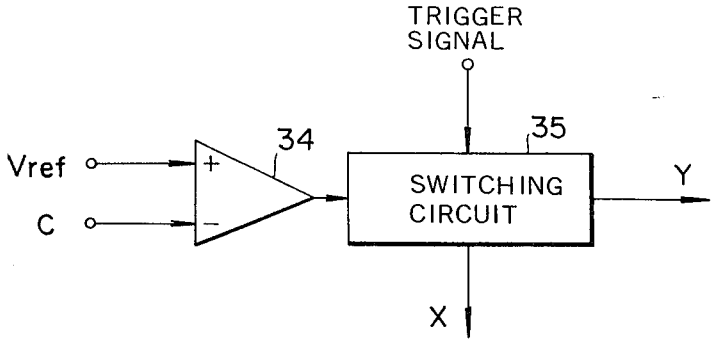
FIG. 3 is a block diagram showing an example of switching circuit in FIG. 1.

The ignition mode switching circuit 20 includes a plurality of switching circuit 21 to 24 and a plurality of pulse generators 25 to 28 respectively connected thereto. Each of the switching circuits 21 to 24 respectively receives a first trigger signal Td to Tg and a signal C indicative of the engine coolant temperature. As shown in FIG. 3, the switching circuit 21 includes a comparator 34 which compares the engine coolant temperature signal C from a temperature sensor connected to the water jacket of the engine, with a predetermined reference signal $V_{ref}$ supplied from the voltage regulator 9 connected to the battery 29 through the ignition switch 11.

When the coolant temperature signal C is smaller than the reference signal $V_{ref}$, the switching circuit directly outputs the first trigger signal Td at a first output terminal Y thereof. Conversely, when the engine coolant temperature signal C is equal to or greater than the reference signal $V_{ref}$, the switching circuit 21 outputs the first trigger signal Td at the second output terminal X thereof.

At each second output terminal X of the switching circuits 21 to 24, there is respectively connected a pulse generator 25 to 28 which generates a pulse train including five pulses as the second trigger signal upon receiving the first trigger signal Td to Tg from the switching circuit 21 to 24.

Each of the pulses of the second trigger signal has an amplitude equal to the first trigger signals Td to Tg and the repetition rate thereof is equal to the minimum dwell angle which occurs at the maximum engine speed.

The first output terminals Y of the switching circuits 21 to 24 and the output terminals of the pulse generators 25 to 28 are connected respectively to output terminals I to IV of the ignition mode switching circuit 20 via diodes connected thereto.

Thus, the ignition mode switching circuit 20 selects one of the first and second ignition modes and selectively outputs one of the first and second trigger signals in accordance with the operation of the switching circuits 21 to 24 which are, in turn, operative as a function of engine coolant temperature.

Each of the respective thyristers *3b* to *6b* (of which only *3b* is specifically shown) of the ignition store and discharge circuits 3 to 6 is triggered by an output signal of the ignition mode switch circuit 20, i.e., one of the respective first and second trigger signals, to cause in turn the energy stored in the respective capacitors *3a* to *6a* (again only the capacitor *3a* is shown) to be discharged to one of the respective spark plugs 30 to 33.

Thus, in accordance with the operation of the ignition mode switching circuit 20, each of the plasma ignition plugs is energized five times within a predetermined amount of crankshaft rotation to unfailingly ensure that the air-fuel charge in the combustion chamber is ignited. When the engine has warmed up sufficiently, the ignition system is returned to the normal single energization mode of operation, according to the operation of the switching circuits 21–24 as described.

In addition, in order to turn off the thyristers 3b–6d after each triggering, the oscillation intermitting circuit 13 which receives the output signals of the ignition mode switching circuit 20 i.e., one of the first and second trigger signals, is provided to stop the operation of the oscillator in the DC-DC inverter 8, thereby ceasing in turn the charging of the capacitors of the ignition energy store and discharge circuits 3 to 6 to turn off each thyristers.

After that, the above operation is repeated.

Figure 4:
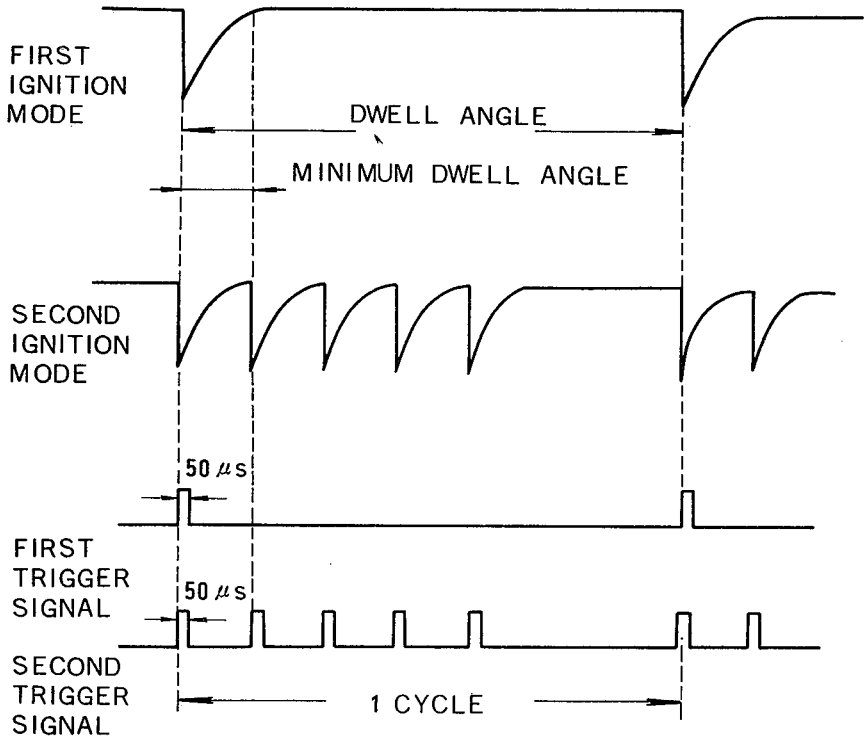
FIG. 4 shows wave forms of the trigger signals and the charging and discharging charactristic of the capacitors in FIG. 1.

The charging characteristic of the capacitor of the ignition energy store and discharge circuits 3 to 6 is shown in FIG. 4.

Thus, this plasma ignition system ensures a smooth starting of the engine even with a low cetane type fuel, without causing misfire by means of a plurality of energizing of the plasma ignition plugs.

In addition, the above embodiment can be modified such that, when the engine cooling water is warmed up, engine operation is switched to a spontaneous combustion condition instead of effecting once per cycle ignition as in the above case. In such a case, the ignition is stopped by cutting-off the power supply of the DC-DC inverter 8 for example, by means of a switching device such as a relay which operates in response to the switching circuits 21 to 24.

Figure 5:
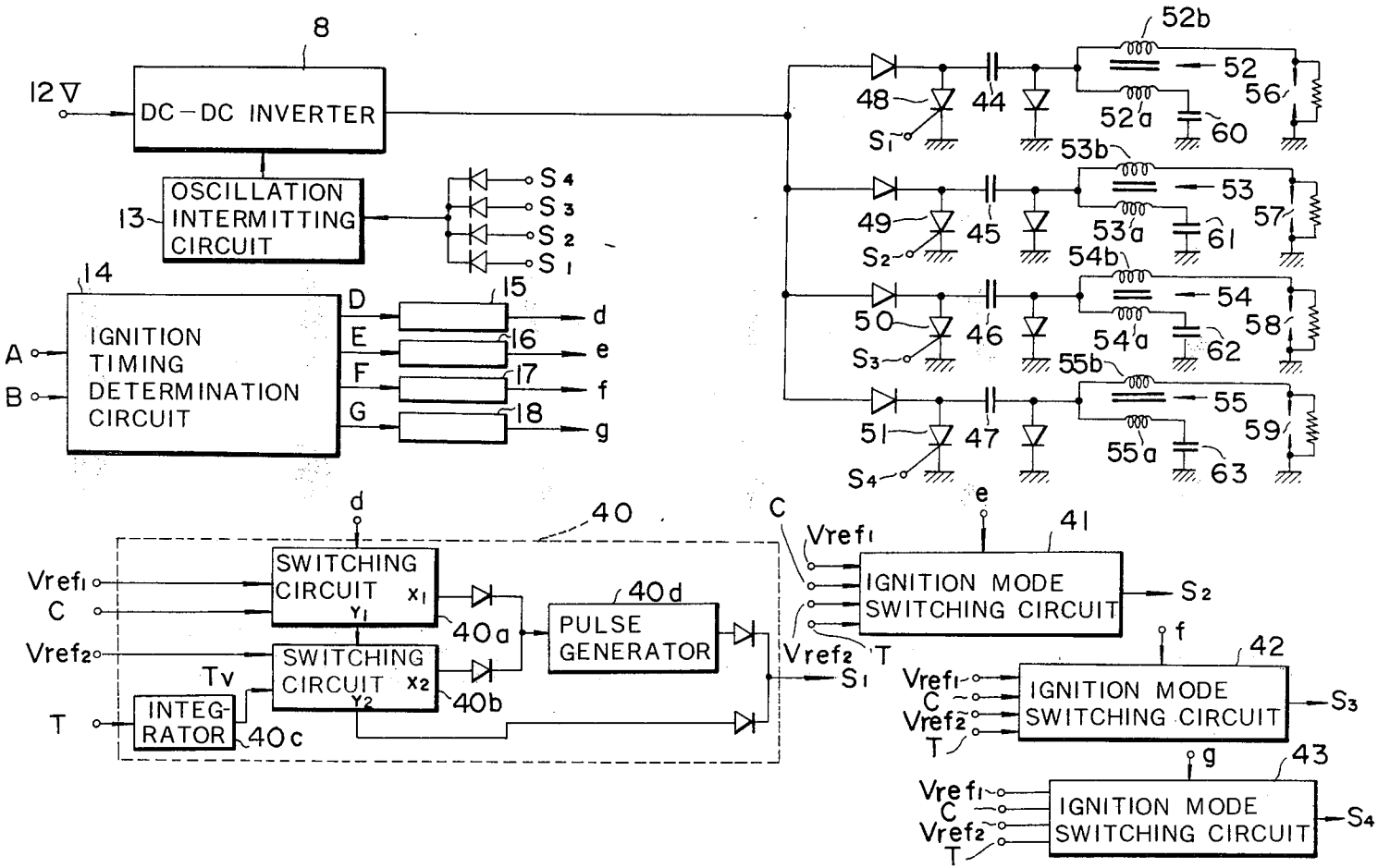
FIG. 5 is a partial block diagram of a second embodiment of the present invention, in the form of a plasma ignition system similar to the first embodiment.

Now reference is made to FIG. 5, which shows a second embodiment of the present invention in the form of a high energy plasma ignition system which can be used in both of the diesel and Otto cycle engines.

In FIG. 5, the circuit portion which has the same circuit construction as in the first embodiment in FIG. 1. is not shown and the explanation thereof is omitted, since the operation thereof is the same as the corresponding circuit portion of the first embodiment.

This high energy plasma ignition system features that the electric energy stored in the capacitors 44 to 47 is respectively into primary windings 52a to 55a of ignition coils 52 to 55, instead of directly energizing the spark plugs. Further, a capacitor 60 to 63 having a capacitance value about one-fourth of that of the capacitors 44 to 47 is respectively provided in series with the primary windings of the ignition coils 52 to 55.

Thus, a high tension voltage generated in a secondary windings 52b to 55b of the ignition coils 52 to 55 is then respectively supplied to the plasma ignition plugs 56 to 59.

This embodiment further features the use of switching circuits 40 to 43 which are somewhat different from the switching circuits 20 to 24 of the first embodiment.

As shown, the switching circuit 40 includes a first switching circuit 40a and a second switching circuit 40b, and the operation thereof is described hereinafter.

The first switching circuit 40a is constructed in the same manner as the switching circuits 21 to 24 in FIG. 1, and outputs the first trigger signal Td from the trigger signal generator 15 at a second output terminal $X_1$ thereof when the coolant temperature signal C from the temperature sensor is smaller than the first reference singal $V_{ref1}$, similar to the reference signal $V_{ref}$ of the previous embodiment. The first switching circuit 40a then outputs the first trigger signal Td at a first output terminal $Y_1$ thereof when the signal C is equal to or greater than the signal $V_{ref1}$.

The second switching circuit 40b is constructed substantially in the same manner as the first switching circuit 40a, but it receives a voltage signal Tv which is produced by a F-V conversion of the engine speed signal T from the crankshaft position sensor, at an integrator circuit 40c and also it receives a second reference signal $V_{ref2}$ produced by a reference signal generation circuit (not shown). Under a condition where the first trigger signal Td is produced at the second output terminal $Y_1$ of the first switching circuit 40a, the second switching circuit 40b outputs, at a second output terminal $X_2$, the trigger signal Td from the output terminal $Y_1$ of the first switching circuit 40a when the voltage signal Tv is smaller than the second reference signal $V_{ref2}$, and outputs the first trigger signal Td at a first output terminal $Y_2$ when the voltage signal Tv is equal to or greater than the second reference signal $V_{ref2}$.

The second output terminals $X_1$ and $X_2$ of the first and second switching circuits 40a and 40b are connected to a pulse generator 40d similar to the pulse generators 25 to 28 in FIG. 1 via diodes connected thereto. When the first trigger signal Td is outputted from either one of the second output terminals $X_1$ and $X_2$, the pulse generator circuit 40d produces a second trigger signal having five pulses (the same as the second trigger signal from the pulse generators 25 to 28 in FIG. 1), and one of the first trigger signal from the first output $Y_2$ of the second switching circuit 40b and the second trigger signal from the pulse generator 40d is outputted as a trigger signal $S_1$.

The logic condition as explained hereinabove is shown in the following table

TABLE

| | | | | |
|---|---|---|---|---|
| Coolant temperature | Low ($C<V_{ref1}$) | Low ($C<V_{ref1}$) | High ($C\geqq V_{ref1}$) | High ($C\geqq V_{ref1}$) |
| Engine speed | Low ($TV<V_{ref2}$) | High ($TV\geqq V_{ref2}$) | Low ($TV<V_{ref2}$) | High ($TV\geqq V_{ref2}$) |
| Number of pulses of Trigger signal | 5 | 5 | 5 | 1 |

The ignition mode switching circuits 41 to 43 are each constructed in a similar manner as the switching circuit 40 and respectively produce the trigger signals S2 to $S_4$ in accordance with the logic shown in the above table.

Accordingly, the thyristers 48 to 51 are triggered by the trigger signal from the switching citcuits 40 to 43. Further, in the case of this embodiment, energization of each spark plug is effected at a rate of five times per one cycle under a condition when the coolant temperature is lower than a predetermined level or when the coolant temperature is higher than the reference level and the engine speed is lower than a predetermined reference level.

This embodiment features that the ignition system can be used with an Otto cycle engine since a high tension ignition voltage is produced by the ignition coils. Therefore, it becomes possible to operate the engine with gasohol with an improved starting efficiency.

Figure 6:
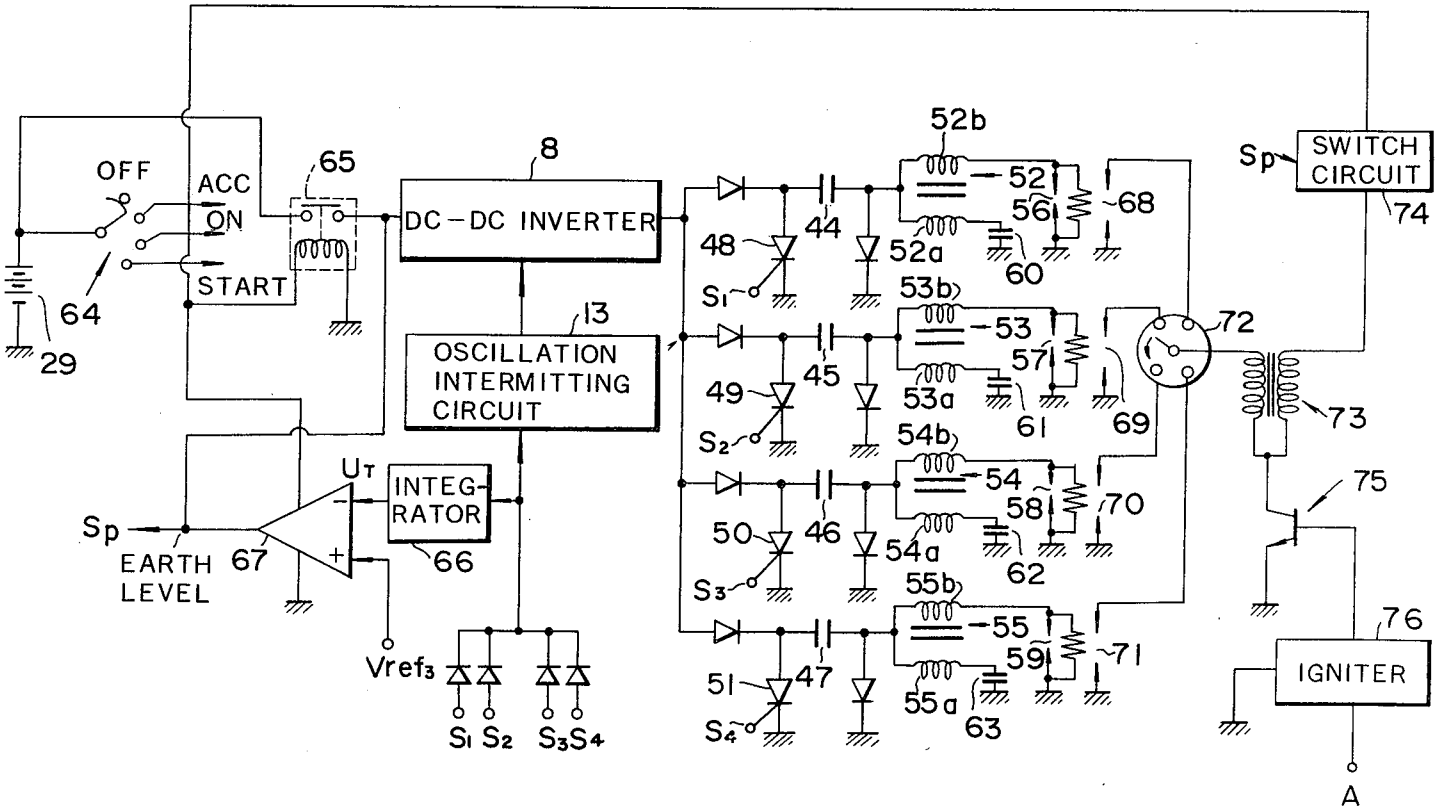
FIG. 6 is a partial block diagram of a third embodiment of the present invention, in the form of an ignition system for an Otto cycle engine.

Turning now to FIG. 6, a third embodiment of the present invention is described hereafter. In FIG. 6, the circuit portions corresponding to that in FIGS. 1 and 5 are designated by the same reference numerals and in which only circuit portions having different construction from that shown in FIG. 1 is depicted.

This third embodiment features that plasma ignition plugs 56 to 59 are utilized in addition to the conventional spark plugs 68 to 71, thereby providing an ignition system in which the plasma ignition occurs five times per cycle during a predetermined period after the engine starting (determined in accordance with the coolant temperature and engine speed in the previous embodiment), and a single plasma ignition occurs per cycle during medium speed engine operation including idling, and a single normal spark ignition occurs once per cycle when the engine is operating at a higher speed.

Specifically, the operation of the plasma ignition system is initiated when a relay 65 is turned on by the operation of the ignition switch 64. At that time, the power voltage is supplied to the DC-DC inverter 8. The thyrister of the ignition energy store and discharge circuit is triggered by the trigger signals $S_1$ to $S_4$ from the ignition mode switching circuit (equal to the trigger signals $S_1$ to $S_4$ from the ignition mode switching circuits 40 to 43), thereby effecting the following function that the plasma ignition occurs five times per cycle when the coolant temperature is low or when the engine speed is low and the coolant temperature is high, and a single plasma ignition occurs once per cycle when the engine speed rises with the rising of the coolant temperature.

Further, since the frequency of the trigger signals $S_1$ to $S_4$ is proportional to the engine operational speed, a voltage signal Ut proportional to the engine speed is produced at an integrator 66 by integrating the trigger signal $S_1$ to $S_4$.

The output signal of the integrator 66 is compared by a comparator 67 with a predetermined reference signal $V_{ref3}$ corresponding to the high speed engine operation.

When an output signal Sp of the comparator 67 is reduced to a low level, i.e., 0 level ($UT < V_{ref3}$), the power supply to the DC-DC inverter is cut off, thereby ceasing the operation of the plasma ignition circuit, and turning the switch circuit 74 on by the low level of the comparator output Sp. The switch circuit 74 starts the operation of a full transistor type ignition system including an igniter 76 which receives the ignition signal A, a power transistor 75 for the switching operation, an ignition coil 73, a distributor 73 and so on, and effects normal spark ignition once per cycle.

In this embodiment, the same effect of improving the engine starting efficiency as the previous embodiment is obtained.

In addition, the system shown in FIG. 6 can be modified such that the normal spark ignition takes place once per cycle throughout the engine operation in addition to the operation of the plasma ignition in the explained manner. In such a case, the switch circuit 74 is not necessary.

Figure 7:
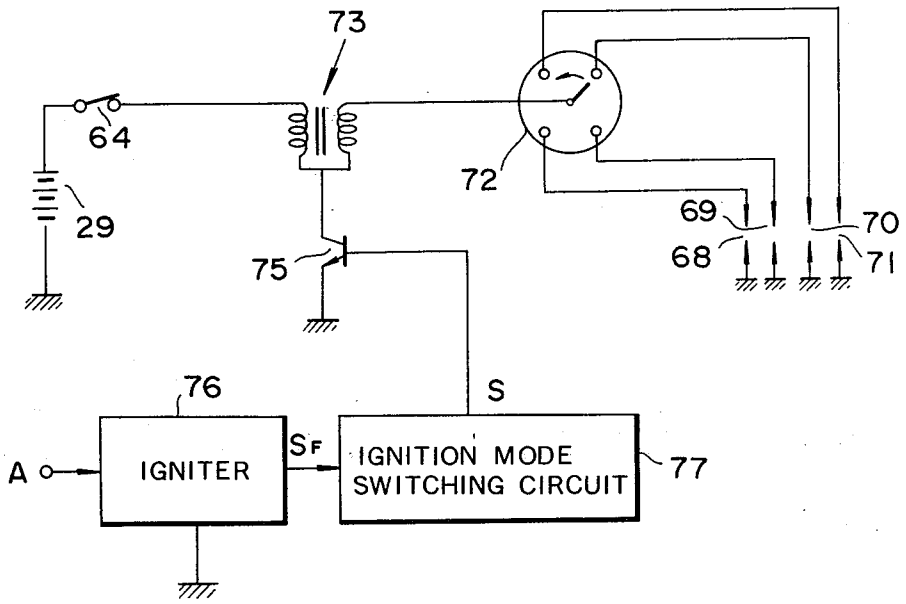
FIG. 7 is a general block diagram of a fourth embodiment of the present invention, in the form of a full transistor ignition system for an Otto cycle engine.

Referring now to FIG. 7, a fourth embodiment which takes the form of a full transistor type ignition system associated with an Otto cycle engine, is explained.

In the figure, the corresponding circuit portions are designated by the same reference numerals used in FIG. 6.

The system includes an ignition timing switching circuit 77 which may be constructed by the combination of the switching circuits 21 to 24 and the pulse generator circuits 25 to 28 shown in FIG. 1, otherwise by a switching circuit similar to that of the ignition mode switching circuits 40 to 43 in FIG. 5.

In either case, a trigger signal including five pulses therein based on the optimum ignition timing signal produced from the ignitor 76 is applied the base of the power transistor 75, and the number of energizations per cycle is varied with the operational condition of the engine, Viz., each of the spark plugs 68 to 71 is energized a plurality of times per cycle during the cold start period, and single energization is effected after the engine has sufficiently warmed up.

With this embodiment, the same effect of improving the combustion efficiency as the previous embodiment is obtained.

While the invention is explained by way of the preferred embodiments wherein the ignition takes place five times per cycle during the cold start engine operation, the number of energizations per cycle of the ignition plugs may be desirably determined from a number greater than twice.

It will be appreciated from the foregoing that, according to the present invention, a plurality of ignitions are effected during the cold engine start operation for increasing the provability of successfully inducing the combustion of an air fuel mixture, thereby improving the starting efficiency of the engine, and a low grade fuel having a low volatility characteristic can be utilized without causing problems.

Furthermore, by the employment of the plasma ignition system, the start efficiency of the engine and the fuel consumption during the medium speed operation and the emission characteristic is greatly improved.

What is claimed is:

1. A method of controlling the ignition of an internal combustion engine having at least one combustion chamber, comprising: effecting a plurality of plasma ignitions in said combustion chamber per cycle of said engine during starting of said engine, effecting a single plasma ignition in said combustion chamber per cycle of said engine upon the occurrence of predetermined conditions after starting of said engine and below a predetermined engine speed, and effecting a single normal spark ignition in said combustion chamber per cycle of said engine when the engine is operating above said predetermined engine speed.

2. A method of controlling ignition of an internal combustion engine as recited in claim 1, wherein said predetermined conditions include at least one of a predetermined engine temperature and a second predetermined engine speed lower than the first mentioned predetermined engine speed.

3. A method as recited in claim 1, wherein said predetermined conditions comprise a predetermined engine temperature and a second predetermined engine speed lower than the first mentioned engine speed.

4. A method as recited in claim 3, wherein a plurality of plasma ignitions are effected in said combustion chamber per cycle of said engine whenever the engine temperature is below said predetermined engine temperature or the engine speed is below said second predetermined engine speed.

5. An ignition system for an internal combustion engine having at least one plasma ignition plug and at least one normal spark ignition plug, comprising: plasma ignition control means to effect a plurality of plasma ignitions at said plasma ignition plug per engine cycle during the staring of said engine and to effect a single plasma ignition at said plasma ignition plug per engine cycle upon the occurrence of predetermined conditions after starting of said engine and below a predetermined speed of said engine, and normal spark ignition control means to effect normal spark ignition at said normal spark ignition plug when the engine is operating above said predetermined engine speed.

6. An ignition system as recited in claim 5, wherein said predetermined operating conditions include at least one of a predetermined engine temperature and a second predetermined engine speed lower than the first mentioned predetermined engine speed.

7. An ignition system for an internal combustion engine as recited in claim 5, wherein said predetermined conditions comprise a predetermined temperature of said engine and a second predetermined engine speed lower than the first mentioned engine speed.

8. An ignition system for an internal combustion engine as recited in claim 7, wherein said plasma ignition control means effects a plurality of plasma ignitions at said plasma ignition plug per engine cycle whenever the engine temperature is below said predetermined engine temperature or the engine speed is below said second predetermined engine speed.

* * * * *